US006871626B2

(12) United States Patent
Kamiyama et al.

(10) Patent No.: US 6,871,626 B2
(45) Date of Patent: Mar. 29, 2005

(54) FOAMED RESIN OIL PAN AND METHOD OF FABRICATION THEREOF

(75) Inventors: Eiichi Kamiyama, Mishima (JP); Kazushige Ueno, Gifu (JP)

(73) Assignees: Toyota Jidosha Kabushiki Kaisha, Toyota (JP); Pacific Industrial Co., Ltd., Ogaki (JP)

( * ) Notice: Subject to any disclaimer, the term of this patent is extended or adjusted under 35 U.S.C. 154(b) by 0 days.

(21) Appl. No.: 10/771,354

(22) Filed: Feb. 5, 2004

(65) Prior Publication Data

US 2004/0154576 A1 Aug. 12, 2004

(30) Foreign Application Priority Data

Feb. 10, 2003 (JP) ..... 2003-032509

(51) Int. Cl.[7] ..... F02F 7/00
(52) U.S. Cl. ..... 123/195 C; 123/196 R
(58) Field of Search ..... 123/195 C, 196 R, 123/198 E; 184/6.5, 6.8

(56) References Cited

U.S. PATENT DOCUMENTS 4,480,609 A * 11/1984 Hayashi ..... 123/195 C
5,375,569 A * 12/1994 Santella ..... 123/90.38
6,640,767 B2 * 11/2003 Kato et al. ..... 123/195 C

FOREIGN PATENT DOCUMENTS

JP 7-1503 * 1/1995
JP A 7-27016 1/1995
JP A 2002-206411 7/2002

* cited by examiner

*Primary Examiner*—Weilun Lo
(74) *Attorney, Agent, or Firm*—Oliff & Berridge, PLC

(57) ABSTRACT

A foamed resin oil pan has a body portion and a flange portion for mounting the body portion on the cylinder block is disclosed. The bubble fraction of the resin constituting the body portion is higher than that of the resin constituting the flange portion. As a result, the strength and rigidity of the flange portion are maintained at high level while at the same time increasing the sound insulating properties and the heat insulating properties.

7 Claims, 8 Drawing Sheets

FOAMED RESIN OIL PAN AND METHOD OF FABRICATION THEREOF

BACKGROUND OF THE INVENTION

1. Field of the Invention

The present invention relates to an oil pan of foamed resin and a method of fabrication thereof.

2. Description of the Related Art

An oil pan, for storing the lubricant to cool and lubricate the interior of an internal combustion engine of automotive vehicles, is arranged under the cylinder block of the internal combustion engine. An oil pan of metal has conventionally been used for strength and rigidity. With the recent advent of a resin having a sufficient strength and rigidity, however, a resin oil pan has been proposed (Japanese unexamined Patent Publication No. 7-27016).

The resin oil pan described in Japanese Unexamined Patent Publication No. 7-27016 is light in weight compared with a metal oil pan and, therefore, can reduce the weight of the internal combustion engine as a whole. Also, the resin oil pan has higher heat insulation properties than the metal oil pan and, therefore, can suppress the discharge of heat of the lubricant in the resin oil pan. Therefore, the temperature of the lubricant can be conveniently increased rapidly in starting the engine from the cold state, for example.

An oil pan of foamed resin has been proposed as a resin oil pan. The foamed resin oil pan has a high heat insulating effect and therefore can strongly suppress the discharge of heat from the lubricant in the oil pan. Further, the foamed resin oil pan has a high sound insulating effect, and can isolate noise generated in the internal combustion engine.

Nevertheless, the foamed resin poses the problem of a reduced rigidity as the result of foaming the resin. Especially, in mounting the oil pan in a liquid-tight fashion on the cylinder block of the internal combustion engine, the flange portion of the oil pan requires a high rigidity. The oil pan made of foamed resin in its entirety, however, has a reduced rigidity at the flange portion so that the lubricant would leak from between the cylinder block and the flange portion of the oil pan.

Accordingly, it is an object of this invention to provide an oil pan having high sound insulation properties and high heat insulation properties while at the same time maintaining the required strength and rigidity, and a method of fabricating the oil pan.

SUMMARY OF THE INVENTION

According to one aspect of this invention, there is provided a foamed resin oil pan comprising a body portion and a flange portion for mounting the body portion on a cylinder block, wherein the bubble fraction (gas content) of the resin making up the body portion is higher than the bubble fraction of the resin making up the flange portion.

In this embodiment, the bubble fraction of the resin of the flange portion is lower than that of the resin of the body portion (the part of the oil pan other than the flange portion). Therefore, a high rigidity required of the flange portion is maintained on the one hand, and the high bubble fraction maintains high heat insulation properties and high sound insulation properties of the body portion, on the other hand.

According to another aspect of the invention, there is provided a foamed resin oil pan, wherein a reinforcing member having a higher strength than resin is arranged on the outer surface or the inner surface of at least that part on the road surface side of the body portion which is located nearer to the road surface when the foamed resin oil pan is mounted on the internal combustion engine.

Generally, the part of the body portion located nearest to the road surface when the oil pan is mounted on the internal combustion engine (hereinafter referred to as "the bottom surface portion") is most liable to contact the road surface when, for example, the vehicle having the internal combustion engine is running. According to this embodiment, a reinforcing member is arranged on the outer surface or the inner surface of at least that bottom surface portion of the body portion or, for example, the outer surface or the inner surface of the part of the oil pan facing the road surface when the oil pan is mounted on the internal combustion engine. In this way, the oil pan is prevented from breaking even in the case where the bottom surface portion of the oil pan comes into contact with the road surface. Especially, the reinforcing member is formed of a material higher in strength and rigidity than the oil pan body portion. In the case where a shock is delivered locally to the bottom surface portion of the oil pan, therefore, the reinforcing member distributes the local shock, while the body portion of the oil pan higher in toughness than the reinforcing member absorbs the shock distributed by the reinforcing member. The reinforcing member may be mounted on the bottom surface portion of the oil pan by any means, including bonding, welding and screwing, which would prevent the reinforcing member from coming off easily.

According to still another aspect of the invention, there is provided a foamed resin oil pan comprising a sheet of a radiation heat insulating material arranged on at least a part of the inner surface of the body portion.

In this aspect of the invention, the provision of the sheet of a radiation heat insulating material on the inner surface of the oil pan prevents the heat of the lubricant in the oil pan from being discharged out of the oil pan by radiation, thereby leading to high heat insulating properties of the oil pan.

According to yet another aspect of the invention, there is provided a foamed resin oil pan, comprising, a metal sheet welded on at least the surface of the flange portion in contact with the cylinder block.

Generally, a sealant (or an adhesive) exhibits a high sealability (adhesion) on the joint between resin members or between metal members. The sealability of the sealant is low, however, in the case where a resin member and a metal member are connected to each other using an inappropriate sealant or carrying out an inappropriate sealing process. The sealability of a sealant is low, therefore, when used to connect a resin oil pan to the cylinder block generally made of a metal. In this case, the seal is liable to be broken even by a small shock in this aspect of the invention, on the other hand, the surface of the flange portion of the oil pan in contact with the cylinder block is made of a metal and, therefore, as metals are connected to each other when the cylinder block and the oil pan are connected to each other, the sealant can exhibit a high sealability. Also, in the case where resin is welded to a metal, the bonding force is higher than in the case where a sealant is used and, therefore, the flange portion of the resin oil pan and the metal sheet are connected firmly to each other. The metal sheet is preferably formed of the same type of metal as the cylinder block.

According to a further aspect of the invention, there is provided a foamed resin oil pan wherein the flange portion has a recess or recesses formed on a surface or the opposite surface thereof in contact with the cylinder block.

To suppress the bubble fraction of the resin of the flange portion, the thickness of the flange portion is required to be low. A thin flange portion, however, would reduce the strength and rigidity of the flange portion. In this aspect of the invention, the provision of a recess in the flange portion increases the strength and rigidity in spite of the substantial thinness of the flange portion.

According to a still further aspect of the invention, there is provided a foamed resin oil pan, wherein the recess is a groove formed along the flange portion in the surface thereof in contact with the cylinder block and a seal member (or a sealing material) is arranged in the groove.

In this aspect of the invention, the provision of the seal member in the groove formed on the flange portion positively assures the sealability between the flange portion and the cylinder block.

According to a yet further aspect of the invention, there is provided a method of fabricating a foamed resin oil pan, comprising the steps of forming a cavity to form the oil pan between a first die and a second die by closing the two dies with each other, filling a molten resin in the cavity, and moving a movable core formed as a part of the first die facing the body portion, in such a manner as to enlarge the cavity.

In this aspect of the invention, the body portion can be foamed simply by moving the movable core in such a manner as to enlarge the cavity. Especially, this fabrication method can foam the body portion substantially uniformly.

BRIEF DESCRIPTION OF THE DRAWINGS

The present invention may be more fully understood from the description of the preferred embodiments of the invention set forth below together with the accompanying drawings, in which.

DESCRIPTION OF THE PREFERRED EMBODIMENTS

Figure 1:
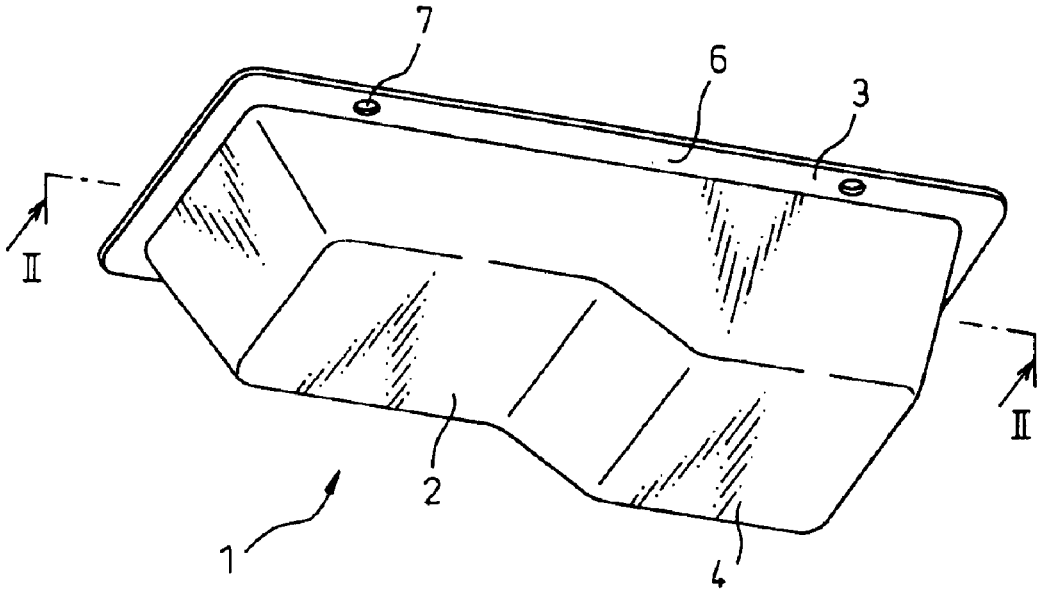
FIG. 1 is a perspective view schematically showing an oil pan according to a first embodiment of the invention.
Figure 2:
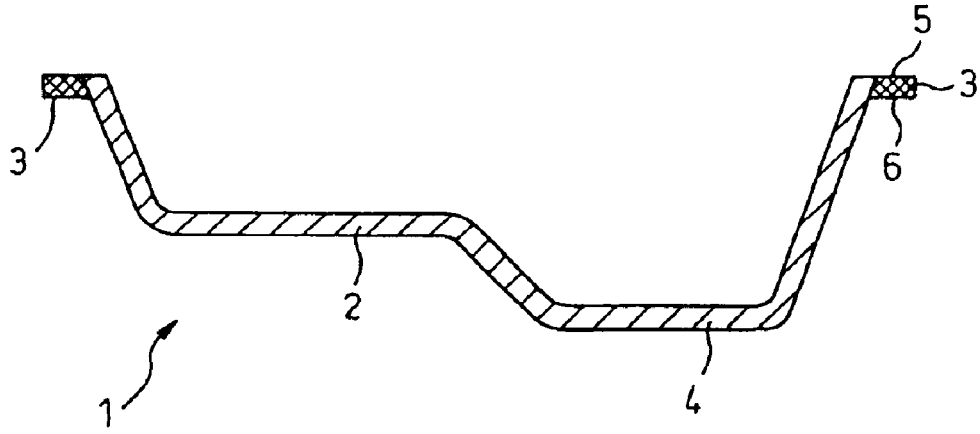
FIG. 2 is a sectional view of an oil pan according to the first embodiment taken in line II—II in FIG. 1.

FIGS. 1 and 2 show an oil pan 1 according to a first embodiment of the invention. In FIG. 2, the hatched part is formed of foamed resin, and the crossed part is formed of resin substantially not foamed. The oil pan 1 comprises a body portion 2 for storing the lubricant when used on the internal combustion engine (not shown) and a flange portion 3 arranged along the peripheral edge of the body portion 2. The body portion 2 is a part other than the flange portion 3 of the oil pan 1, and includes a bottom surface portion 4 located farthest from the flange portion 3. The bottom surface portion 4 is located nearest to the road surface when the oil pan 1 is mounted on the internal combustion engine.

The flange portion 3, on the other hand, includes a mounting surface 5 facing the mounting surface of the cylinder block (not shown) of the internal combustion engine when the oil pan 1 is mounted on the cylinder block and a lower surface 6 located on the opposed side of the mounting surface 5. A plurality of bolt holes 7 are formed through the flange portion 3 between the mounting surface 5 and the lower surface 6. By fastening the bolts (not shown) to the cylinder block through the bolt holes 7, the oil pan 1 is mounted on the cylinder block. When mounting the oil pan 1 on the cylinder block, a sealant is applied between the mounting surface 5 of the flange portion 3 and the mounting surface of the cylinder block.

The oil pan 1 is formed of a resin. More specifically, the resin making up the flange portion 3 is not substantially foamed but is substantially solid. The resin making up the body portion 2, on the other hand, is foamed to the degree necessary to secure the strength and rigidity required of the oil pan. As long as the bubble fraction (gas content; the ratio of gas bubbles existing in a unit volume) of the resin making up the flange portion 3 is lower than the bubble fraction of the resin making up the body portion 2, however, the resin making up the oil pan 1 may be foamed in any manner.

The oil pan made up of a foamed resin instead of a metal is not only light in weight but also transmits less noise from the internal combustion engine on which it is mounted, due to the sound insulating effect of the foamed resin. Also, the heat insulating effect of the foamed resin rapidly increases the temperature of the lubricant stored in the oil pan when the engine is started from the cold state. The oil pan made of a foamed resin, however, is lower in strength and rigidity than the oil pan made of a not foamed resin. Especially, in the case where the flange portion of the oil pan is made of a foamed resin and is reduced in strength and rigidity, the oil pan may not be mounted optimally on the cylinder block. Specifically, the low strength and rigidity of the oil pan, which is generally mounted on the cylinder block by a sealant or an adhesive with bolts, would deform the part of the flange portion located between adjacent bolts under a shock which may be applied to the oil pan, and the particular part would come off from the cylinder block in spite of the sealant or the adhesive used, with the probable result that the lubricant would leak from the particular part.

The flange portion 3 of the foamed resin oil pan 1 according to the first embodiment of the invention, in contrast, is made of a substantially solid resin and has a higher strength and rigidity. Even in the case where a shock is applied to the oil pan 1, therefore, the flange portion 3 is kept sealed to the cylinder block and the lubricant is prevented from leaking.

The oil pan 1 according to the first embodiment of the invention comprising the flange portion 3 made of a solid resin and the body portion 2 made of a foamed resin, therefore, can be mounted on the cylinder block in positively sealed state without adversely affecting the advantages of the foamed resin described later.

Figure 3:
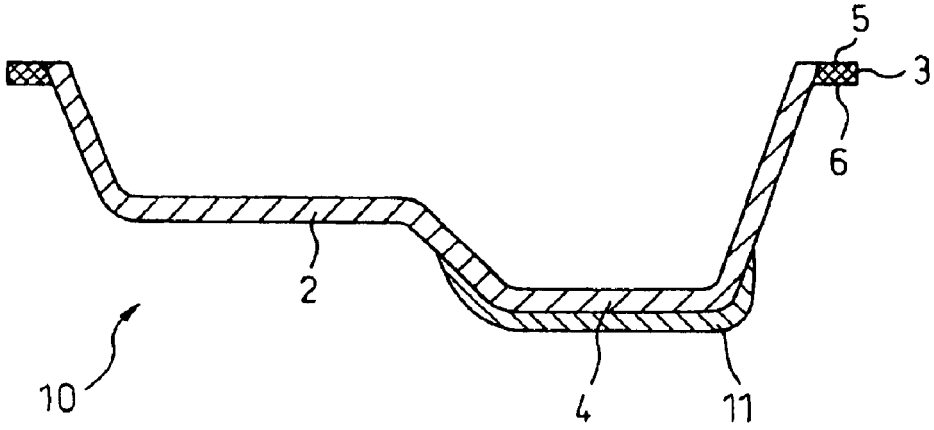
FIG. 3 is a sectional view similar to FIG. 2 showing an oil pan according to a second embodiment of the invention.

Next, an oil pan according to a second embodiment of the invention is explained with reference to FIG. 3. FIG. 3 is a diagram similar to FIG. 2, and the components identical or similar to the corresponding ones of the oil pan 1 in the first embodiment are designated by the same reference numerals, respectively the oil pan 10 according to the second embodiment, though basically the same as the oil pan 1 according to the first embodiment, further comprises a reinforcing member 11 covering the whole outer surface of the bottom surface portion 4 of the body portion 2. Specifically, the reinforcing member 11 is arranged on that part of the outer surface of the body portion 2 which is nearer to the road surface. The reinforcing member 11 is formed of a material harder (a material higher in strength and rigidity) than the resin of the body portion 2 or, for example, a fiber-reinforced plastic (FRP) containing long glass fibers.

When the oil pan 10 according to the second embodiment comes into contact with the road surface while the vehicle carrying the internal combustion engine having the oil pan 10 is running, the reinforcing member 11 of high strength first touches the road surface, while the body portion 2 is kept out of contact with the road surface. Thus, the body portion 2 receives no large shock directly from the road surf ace and, therefore, the shock resistance of the oil pan 10 is improved. In this way, the provision of the reinforcing member 11 prevents the body portion 2 of the oil pan 10 from being broken by a shock which otherwise might be received by contact with the road surface, even in the case where the internal combustion engine is run in the cold reason and the resin of the body portion 2 hardens by being cooled and becomes liable to break. Further, with the oil pan 10 according to the second embodiment, the fact that the reinforcing member 11 is formed of FRP improves the shock resistance of the oil pan 10 while keeping the whole oil pan 10 light in weight. In this embodiment, the reinforcing member 11 is arranged only on the part of the body portion 2 nearest to the road surface to reduce the weight as much as possible. In the case where priority is given to an improved shock resistance, however, the reinforcing member is arranged on the whole surface of the body portion 2 facing to the road surface. As another alternative, in order to further reduce the weight, the reinforcing member may be arranged only on a predetermined part of the bottom surface portion 4. Generally speaking, the reinforcing member should be arranged on the outer surface and/or the inner surface of at least the part of the body portion 2 nearer to the road surface.

Figure 4:
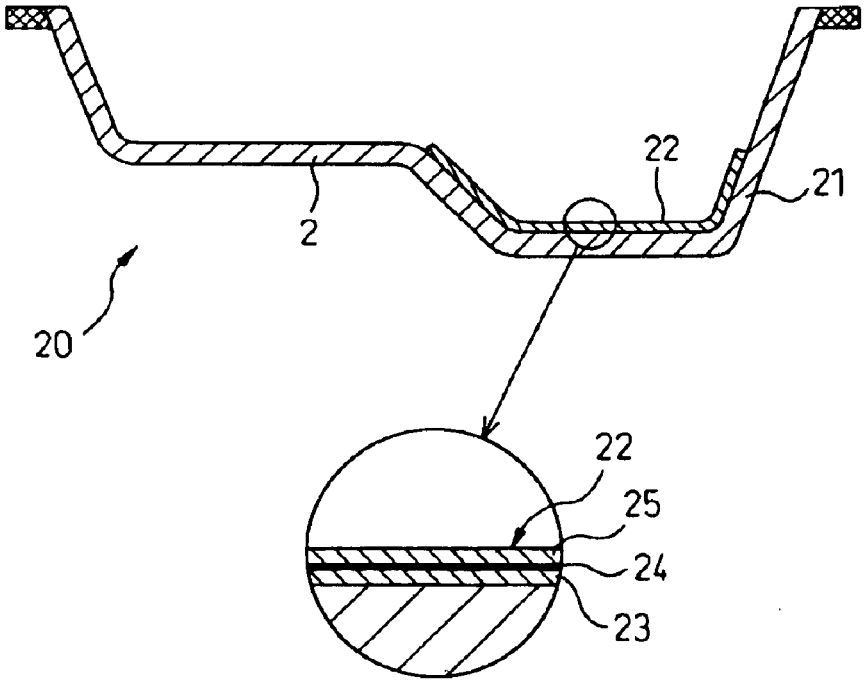
FIG. 4 is a sectional view similar to FIG. 2 showing an oil pan according to a third embodiment of the invention.

Next, the oil pan according to a third embodiment of the invention is explained with reference to FIG. 4. FIG. 4 is a diagram similar to FIG. 2, and the components identical or similar to the corresponding ones of the oil pan 1 in the first embodiment are designated by the same reference numerals, respectively. The oil pan 20 according to the third embodiment, though basically the same as the oil pan 1 according to the first embodiment, has a lamination sheet 22 welded to the inner surface of that part (hereinafter referred to as "the oil pool") 21 of the body portion 2 of the oil pan 20 where the, lubricant is actually stored. The lamination sheet 22 is composed of two resin sheets 23 and 25 with an aluminum sheet 24 sandwiched therebetween as shown in an enlarged view in FIG. 4. The resin sheets 23 and 25 are welded to one and the other sides, respectively, of the aluminum sheet 24.

In the oil pan 20 according to the third embodiment, the provision of the lamination sheet 22, or especially the aluminum sheet 24, on the inner surface of the oil pool 21 of the body portion 2 prevents heat from being radiated out of the oil pan 20 from the lubricant stored in the oil pool 21. As a result, the lubricant can be rapidly heated from a low temperature, for example, then starting the engine from the cold state. In the case where the lubricant stored in the oil pan 20 is acidic or alkaline, the resin making up the body portion 2 would degenerate. The interposition of the aluminum sheet 24 between the body portion 2 and the lubricant, however, prevents the degeneration of the resin.

The lamination sheet 22 includes resin sheets 23 and 25 stacked in such a manner as to cover the aluminum sheet 24. The resin sheet 25 formed on the side of the aluminum sheet 24 facing the lubricant prevents the corrosion of the aluminum sheet 24 which otherwise might be caused by contact with the air. Also, the resin sheet 23 formed on the side of the aluminum sheet 24 facing the body portion 2 improves the adhesion between the lamination sheet 22 and the body portion 2.

The lamination sheet 22 may be formed of other materials and in other forms as long as the radiation heat can be insulated. For example, an un-stacked aluminum sheet or aluminum plating may alternatively be used. Also, the bonding or other method than welding may be employed to connect the sheets 23, 24 and 25 of the lamination sheet 22 to each other or the lamination sheet 22 and the inner surface of the body portion 2 to each other. Further, the lamination sheet 22 may be formed on any part of the inner surface of the body portion 2, or on the whole inner surface of the body portion 2, in addition to on the oil pool 21 alone. Further, the oil pan 20 according to the third embodiment may be based not only on the oil pan 1 according to the first embodiment but also on the oil pan 10 according to the second embodiment.

Figure 5:
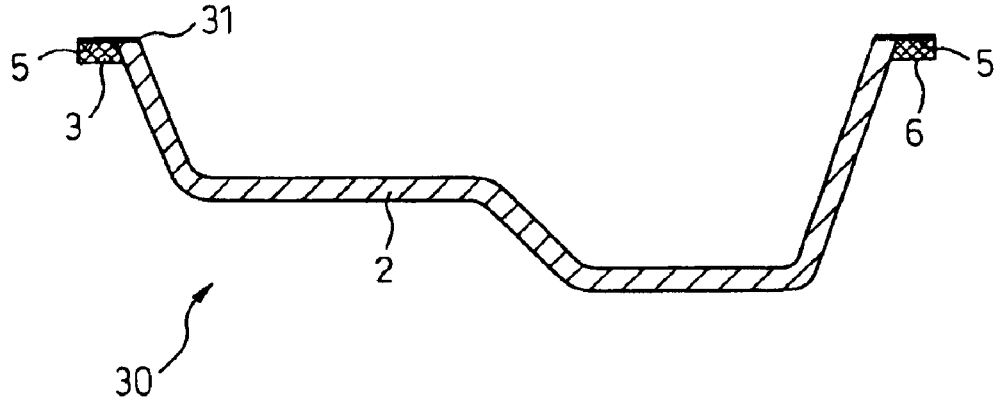
FIG. 5 is a sectional view similar to FIG. 2 showing an oil pan according to a fourth embodiment of the invention.

Next, an oil pan 30 according to a fourth embodiment of the invention is explained with reference to FIG. 5. FIG. 5 is a diagram similar to FIG. 2, and the component elements identical or similar to the corresponding ones of the oil pan 1 according to the first embodiment are designated by the same reference numerals, respectively. The oil pan 30 according to the fourth embodiment, though basically similar to the oil pan 1 according to the first embodiment, is such that a metal sheet 31 is welded on the mounting surface 5 of the flange portion 3 in such a manner as to cover the mounting surface 5.

Generally, the formed-in-place gasket (FIPG) material used on the mounting surfaces of the cylinder block and the oil pan is a material suitable for connecting the same type of materials (for example, aluminum with aluminum, steel with steel or resin with resin), and if used between different types of materials, is slightly reduced in sealability and adhesion. With the oil pan according to the fourth embodiment, in contrast, the metal sheet 31 of the same type of metal as the cylinder block is welded on the mounting surface 5 of the flange portion 3. Even in the case where the oil pan 30 is mounted on the cylinder block using the normal FIPG material, therefore, the mounting surface of the cylinder block and the mounting surface of the oil pan can be sufficiently sealed and bonded to each other. Especially, according to this embodiment, an aluminum cylinder block is used and the aluminum sheet 31 is welded on the mounting surface 5 of the flange portion 3.

Figure 6:
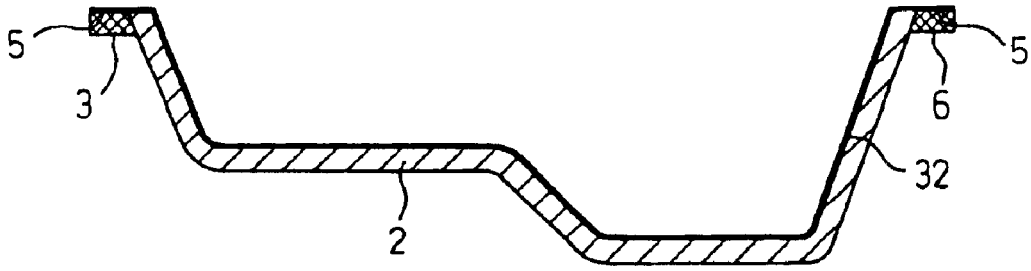
FIG. 6 is a sectional view similar to FIG. 2 showing an oil pan according to a modification of the fourth embodiment of the invention.

With the oil pan 30 according to this embodiment, the aluminum sheet 31 is arranged at least on the mounting surface 5 of the flange portion 3 as shown in FIG. 6, therefore, an aluminum sheet 32 may be arranged over the mounting surface 5 of the flange portion 3 and the entire inner surface of the body portion 2. In this way, the effects of not only this embodiment but also the third embodiment are exhibited. Also, the metal sheet 31 may be formed of any metal material such as steel that can be sealed firmly to the metal making up the cylinder block by the formed-in-place gasket. Further, the oil pan 30 according to this embodiment may be combined with any of the oil pans according to the first to third embodiments.

Figure 7A:
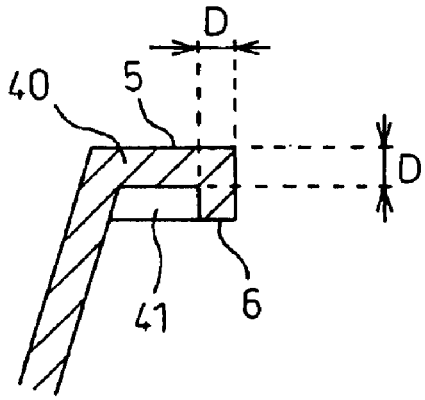
FIGS. 7*a* and 7*b* are diagrams showing the flange portion of an oil pan according to a fifth embodiment of the invention.
Figure 7B:
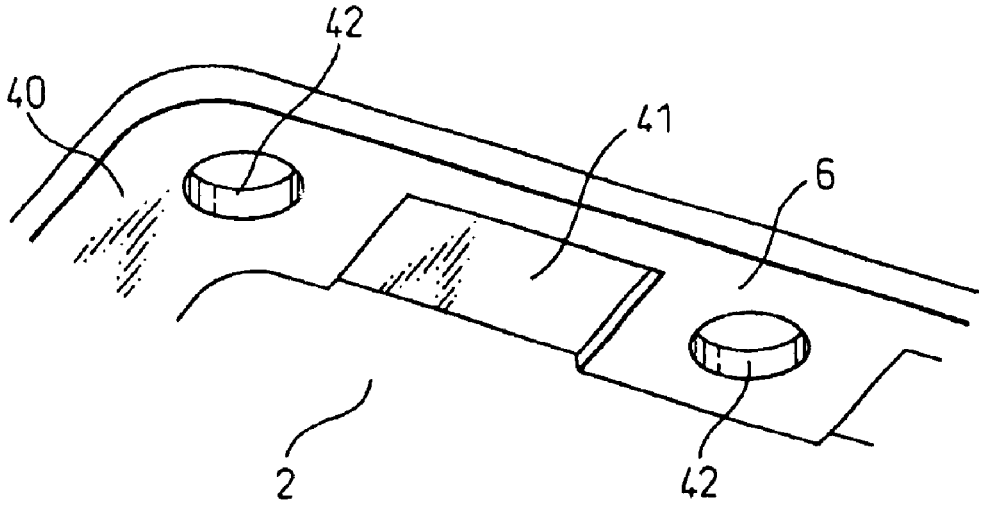
Figure 8:
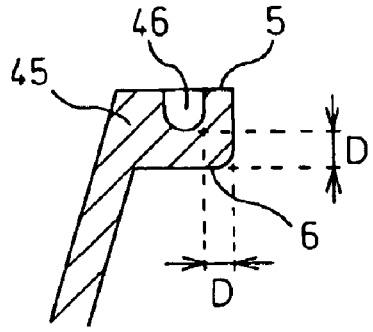
FIG. 8 is a diagram showing the flange portion of an oil pan according to a modification of the fifth embodiment of the invention.

Next, an oil pan according to a fifth embodiment of the invention is explained with reference to FIGS. 7*a*, 7*b* and 8. The oil pan according to the fifth embodiment is basically the same as the oil pan according to the first embodiment. In FIGS. 7*a*, 7*b* and 8, the components identical or similar to those of the oil pan 1 according to the first embodiment are designated by the same reference numerals, respectively. FIG. 7*a* is an enlarged sectional view of the flange portion 40, and FIG. 7*b* is an enlarged perspective view of the flange portion 40. As shown in FIG. 7*a*, the flange portion 40 has in the lower surface 6 thereof a plurality of recesses 41 extending partially along the flange portion 40. As shown in FIG. 7*b*, each recess 41 is not arranged in the, neighborhood of bolt holes 42 formed in the flange portion 40 but extends between adjacent bolt holes 42. The depth of each recess 41. (the length along the thickness of the flange portion 40) is smaller than the thickness of the flange portion 40 between the mounting surface 5 and the lower surface 6. Therefore, the recesses 41 are not formed through the flange portion 40.

An increased thickness of the flange portion 40 would undesirably foam the resin of the flange portion 40 when the oil pan is molded by the molding method described later. Once the resin of the flange portion 40 has been foamed, the strength and rigidity are reduced in spite of the increased thickness thereof. In the oil pan according to the fifth embodiment, in contrast, the strength and the rigidity of the flange portion 40 can be increased as compared with a flat flange portion, while at the same time maintaining a comparatively small real thickness D of the flange portion 40, i.e. preventing the resin of the flange portion 40 from being foamed in the molding process. According to the fifth embodiment, therefore, the strength and the rigidity of the flange portion 40 can be increased by arranging the recesses 41 on the flange portion 40. The thickness D shown in FIG. 7*a* is an example of the real thickness of the flange portion 40, and the "real thickness" of the flange portion 40 includes the thickness of the part of the flange portion 40 between, for example, each recess 41 and the bolt holes 42.

FIG. 8 shows an oil pan according to a modification of the fifth embodiment of the invention. In the flange portion 45 according to this modification, unlike the flange portion 40 according to the fifth embodiment, recesses 46 are formed on the mounting surface 5. In the other points, the recesses 46 are basically formed similarly to the recesses 41 according to the fifth embodiment. Also in this modification, therefore, the strength and the rigidity of the flange portion 45, in spite of a comparatively small real thickness D of the flange portion 45, are increased as compared with a flange portion flat in shape.

The oil pan according to the fifth embodiment or a modification thereof can be combined with any one of the oil pans according to the first to fourth embodiments.

Figure 9:
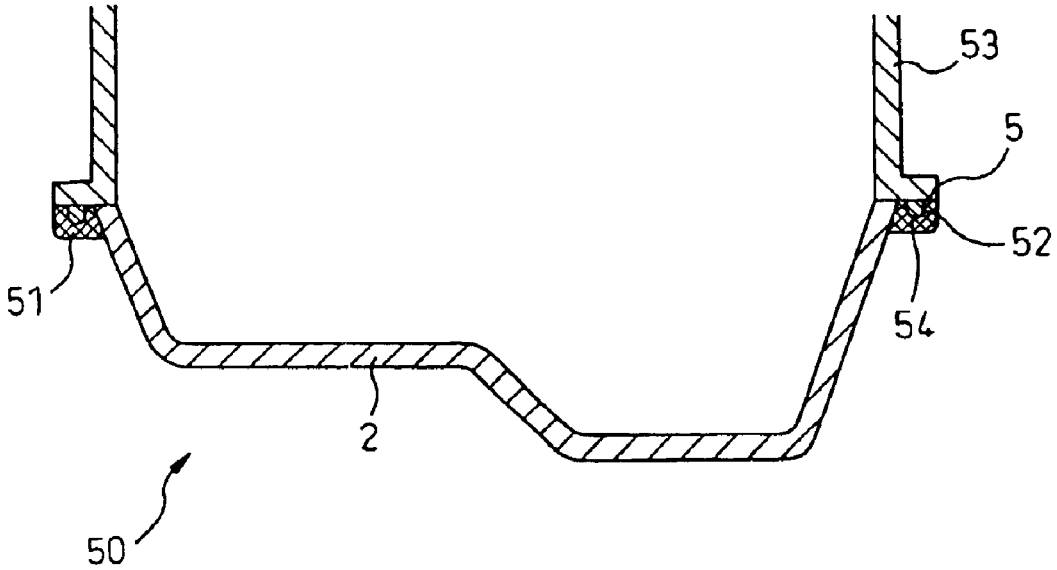
FIG. 9 is a sectional view similar to FIG. 2 showing an oil pan according to a sixth embodiment of the invention.

Next, an oil pan 50 according to a sixth embodiment of the invention is explained with reference to FIG. 9. The oil pan 50 according to the sixth embodiment is basically the same as the oil pan according to the modification of the fifth embodiment. In the oil pan 50 according to the sixth embodiment, a flange portion 51 has a similar shape to the flange portion 45 according to the modification of the fifth embodiment. A groove 52 formed in the mounting surface 5 of the flange portion 51, however, extends not between the bolt holes 42 alone but, unlike the recess 46, over the entire periphery of the flange portion 51. When the oil pan 50 is mounted on the cylinder block 53, an elastic member (rubber, sponge, cork or the like) in a shape complementary with the groove 52 and slightly larger than the groove 52 is arranged in the groove 52. By arranging the elastic member 54 having a shape complementary with the groove 52 in the groove 52 extending over the entire periphery of the flange portion 51 as a sealant in this way, the cylinder block 52 and the oil pan 50 can be positively sealed to each other.

In the case where the cylinder block and the oil pan are sealed to each other by the conventional method using a FIPG material or the like, the oil pan, once mounted on the cylinder block, is difficult to remove and the FIPG material cannot be reused. In the oil pan 50 according to the sixth embodiment, in contrast, the elastic member 54 is used as a sealant. Therefore, the oil pan 50 can be easily removed, and the elastic member 54 can be reused as a sealant.

The resin used in the above embodiments includes polyproylene, polyurethane, polystyrene or nylon. Nevertheless, any other resin having a comparatively high strength and capable of being foamed can be used with equal effect. Also, a foaming agent may be mixed in the molten resin in the molding process.

Figure 10A:
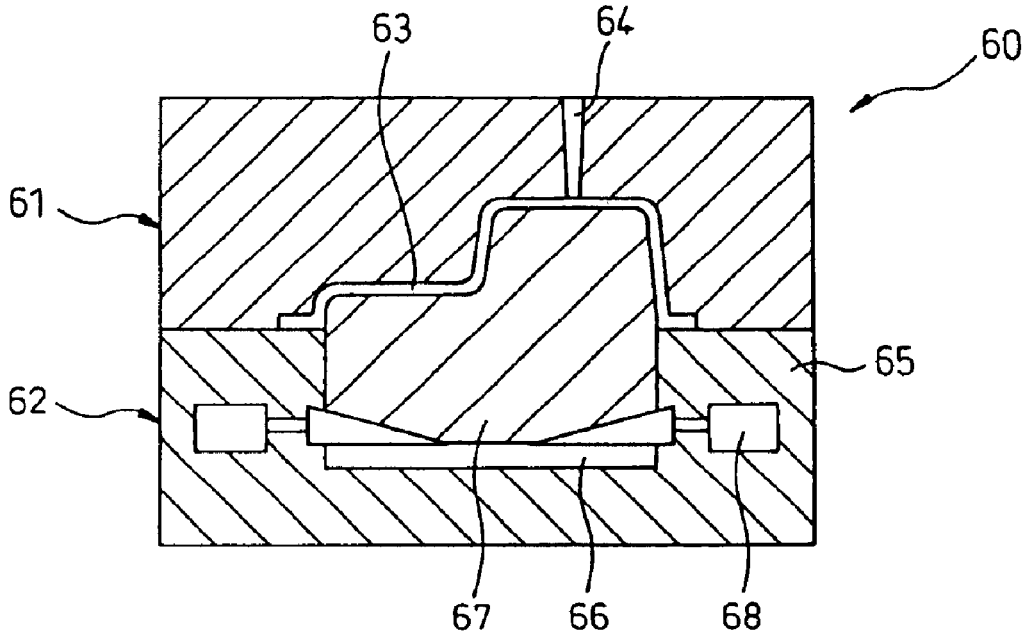
FIGS. 10*a* and 10*b* are diagrams showing a method of fabricating the oil pan described in the first embodiment of the invention.
Figure 10B:
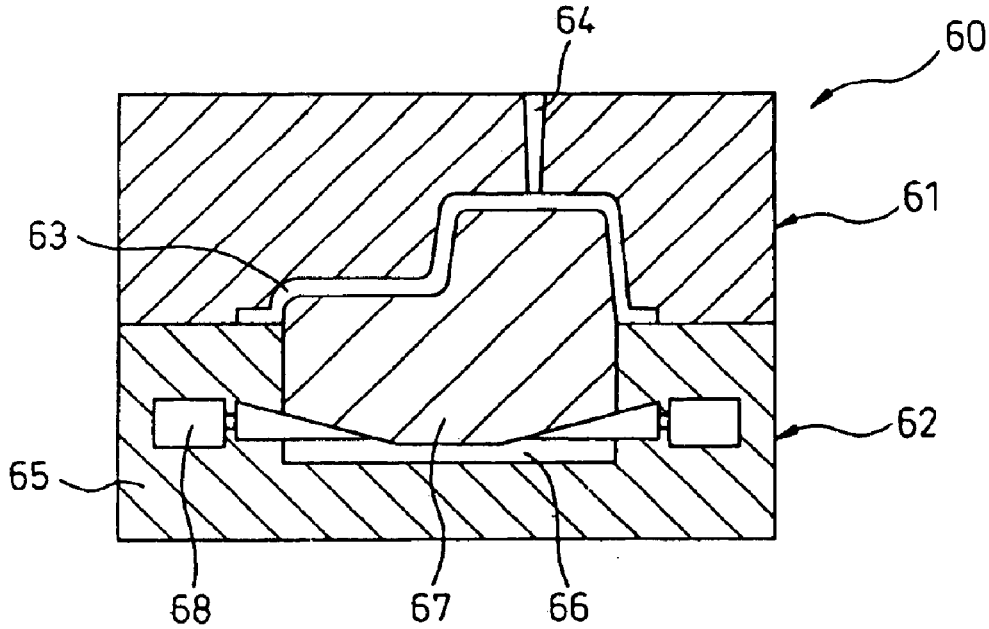

Next, a method of fabricating the oil pan described in the first embodiment of the invention is explained with reference to FIGS. 10*a* and 10*b*. As shown in FIGS. 10*a* and 10*b*, an oil pan fabrication device 60 has two dies including a female die (second die) 61 and a male die (first die) 62. A cavity 63 is formed between the female die 61 and the male die 62, and through a casting hole 64 communicating with the cavity 63, the resin to form the oil pan is filled in the cavity 63 thereby to form the oil pan. The male die 62 includes a male die body portion 65, and a movable core 67 arranged in a recess 66 formed in the male body portion 65 and movable along such directions as to open or close the male die 62 and the female die 61. The movable core 67 is driven by a drive unit 68 arranged in the male die body portion 65. Also, the movable core 67 is arranged in such a manner as to form the cavity 63 substantially with the female 61 when the dies 61 and 62 are closed with each other. More specifically, the movable core 67 is arranged so as to face the body portion 2 but not to face the flange portion 3 of the oil pan formed in the cavity 63. When the dies 61 and 62 are closed with each other and the resin is filled in, therefore, the movable core 67 molds the body portion 2 in cooperation with the female die 61.

A method of molding the oil pan according to the first embodiment using the fabrication device 68 described above is explained. First, the movable core 67 is moved to a position most projected from the male body portion 65 (the uppermost position in FIGS. 10*a* and 10*b*, hereinafter referred to as "the projected position") by the drive unit 68. After that, as shown in FIG. 10*a*, the female die 61 and the male die 62 are closed with each other and, through the casting hole 64, the molten resin for molding the oil pan is filled under pressure in the cavity 63. In this stage, the molten resin filled in the cavity 63 is not yet-substantially foamed.

After the resin is completely filled in the cavity 63, as shown in FIG. 10*b*, the movable core 67 is moved to a position retracted into the recess 66 of the male body portion 65 (the lowermost position in FIGS. 10*a* and 10*b*, hereinafter referred to as "the retracted position"). Since the resin has already been substantially completely filled in the cavity 63 by this time, the movable core 67 moved to the retracted position enlarges the cavity 63 so that the resin thus far pressured is reduced in pressure thereby to foam the resin in the cavity 63. A reduced pressure foams not only the resin filled in the part of the cavity 63 where the distance is increased between the female die 61 and the movable core 67 but also the resin filled in the part of the cavity 63 where this distance is substantially not increased (such as the part of the cavity 63 substantially parallel to the direction of movement of the movable core 67). As a result, the resin is foamed substantially uniformly over the entire body portion 2 of the oil pan molded. Nevertheless, the resin in direct contact with the female die 61, the male die body portion 65 and the movable core 67, which has already been cooled and solidified by the time when the movable core 67 begins to move, is not substantially foamed even when the movable core 67 is moved. Finally, therefore, an oil pan 1 is molded with the surfaces not foamed but only the interior, sandwiched between the surfaces, foamed.

Further, the flange portion 3 of the oil pan molded in the manner described above does not face onto the movable core 67 and is molded between the male die 61 and the female die body portion 65. Also, the flange portion 3 is comparatively thin and arranged in a spaced relation with the resin filling position (the position of the casting hole 64). Therefore, the molten resin is solidified as soon as it is filled in the portion of the cavity 63 corresponding to the flange portion 3. In the flange portion 3, therefore, most of the resin filled in is solidified immediately. Even in the case where the movable core 67 is moved, the resin cannot be effectively reduced in pressure so that the resin of the flange portion 3 is not substantially foamed.

After moving the movable core 67 to the retracted position, the resin is cooled and then the molded oil pan 1 is retrieved by opening the male die 61 and the female die 62. In this way, the oil pan 1 according to the first embodiment is molded. This molding process is repeated to produce the oil pans 1 continuously.

Figure 11A:
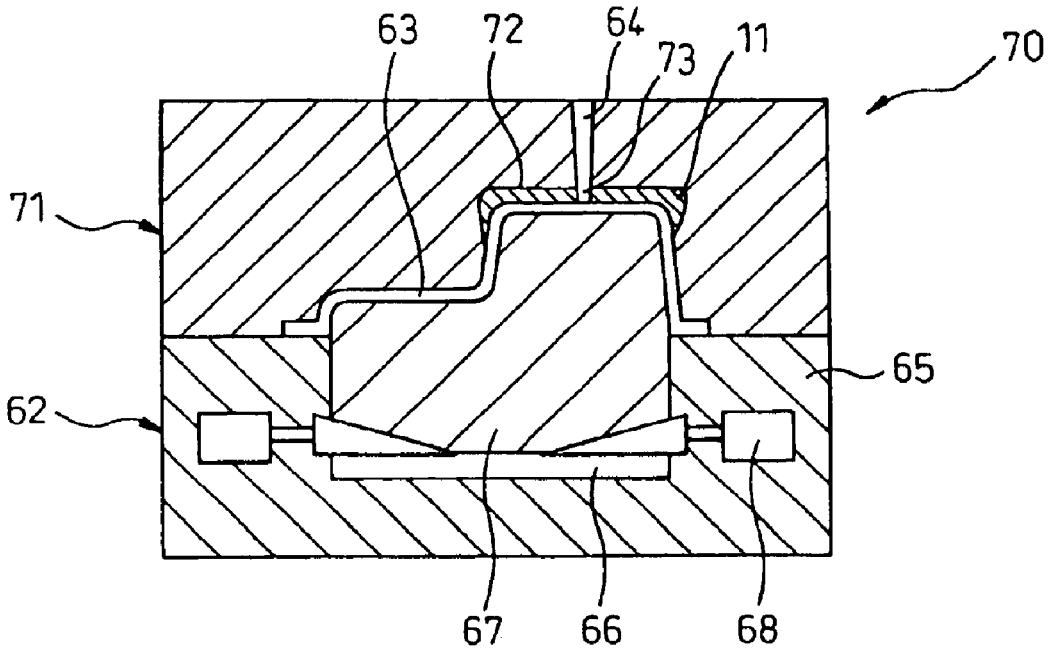
FIGS. 11*a* and 11*b* are diagrams showing a method of fabricating the oil pan described in the second embodiment of the invention.
Figure 11B:
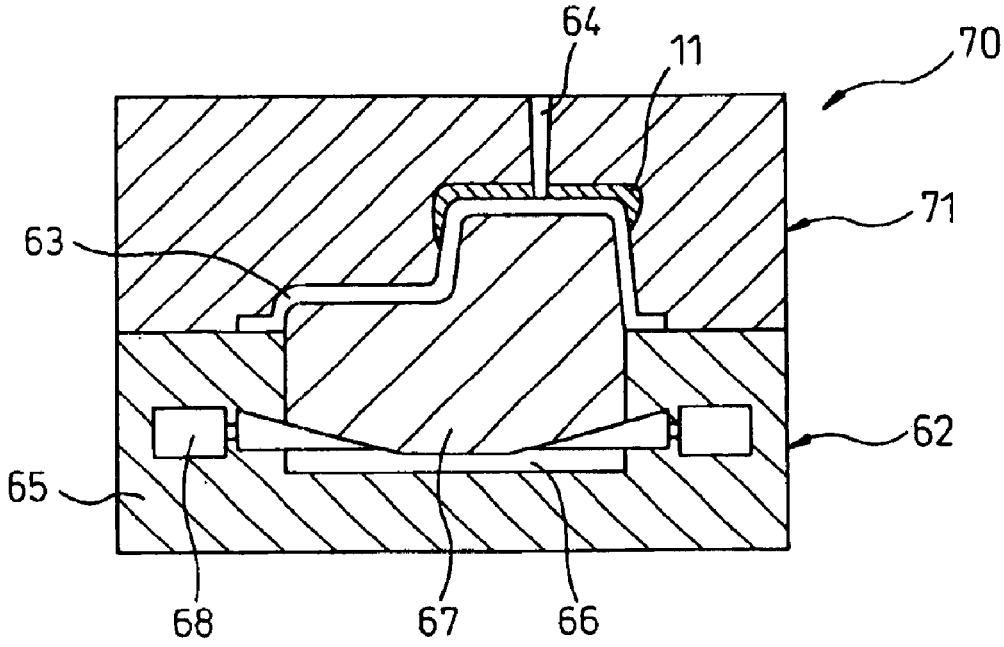

Next, a method of fabricating the oil pan according to the second embodiment is explained with reference to FIGS. 11*a* and 11*b*. A fabrication device 70 for the oil pan according to the second embodiment is basically similar to the fabrication device 60 for the oil pan 1 according to the first embodiment, and the components identical or similar to those of the fabrication device 60 are designated by the same reference numerals, respectively. The fabrication device 70, unlike the fabrication device 60, has an area 72 where a reinforcing member 11 is arranged (hereinafter referred to as "the member arranging area") in the female die 71. By arranging the reinforcing member 11 in this member arranging area 72, substantially the same cavity as the cavity 63 of the fabrication device 60 is formed between the female die 71 and the male die 62.

A method of molding the oil pan 10 according to the second embodiment using the fabrication device 70 described above is explained. The method of molding the oil pan 10 according to the second embodiment is basically the same as the method of molding the oil pan 1 according to the first embodiment. Therefore, only a difference, with regard to the method of molding pan 1 according to the first embodiment, is explained. In the molding method according to this embodiment, the reinforcing member 11 is arranged in the member arranging area 72 of the female die 71 before the female die 71 and the male die 62 are closed with each other, and after the reinforcing member 11 is arranged, the female die 71 and the male die 61 are closed with each other. Also, the reinforcing member 11 includes a through hole 73 adapted to be aligned with a casting hole 64 when the reinforcing member 11 is arranged in the member arranging area 72, and the molten resin is filled in the cavity 63 through the through hole 73 and the casting hole 64. Incidentally, the melting point of the reinforcing member 11 is higher than that of the resin making up the body portion 2 of the oil pan 10. Even after the molten resin is filled in the cavity 63, therefore, the reinforcing member 11 is hardly molten or only the surface thereof in contact with the molten resin is slightly molten.

According to this method of fabricating the oil pan 10, the resin in molten state making up the body portion 2 of the oil pan 10 comes into contact with the surface of the reinforcing member 11. Therefore, the reinforcing member 11 is firmly coupled with the body portion 2 of the oil pan 10. The reinforcing member 11 is preformed by pressing, for example, a resin containing long glass fibers or carbon fibers.

The oil pans according to the third and fourth embodiments are also molded in the same manner as the method of fabricating the oil pan 10 according to the second embodiment. In the method of fabricating the oil pan 20 according to the third embodiment, for example, the dies 62 and 71 are closed with each other with the lamination sheet 22 arranged on the movable core 67, after which the molten resin is filled in the cavity 63.

The advantages of using the foamed resin for the body portion 2 of the oil pan as in the above embodiments are explained with reference to FIGS. 12 and 13.

Figure 12:
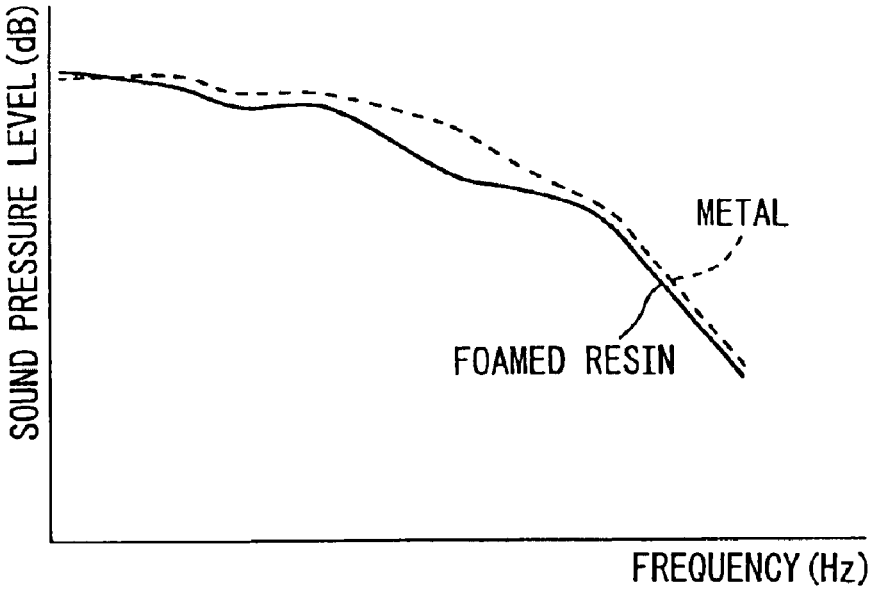
FIG. 12 is a diagram showing the sound insulating effect of the oil pan.

First, by forming the oil pan of foamed resin, the noise generated in the internal combustion engine with the oil pan mounted thereon is reduced by the sound insulating effect of the foamed resin in the manner shown in FIG. 12. FIG. 12 shows the analysis of the noises collected by a microphone installed on the front lower part of the internal combustion engine in operation. The abscissa represents the frequency and the ordinate the sound pressure level. In FIG. 12, the solid line indicates the result of analysis for a foamed resin oil pan, and the dashed line the result of analysis for a metal oil pan. As understood from FIG. 12, the sound pressure level for the foamed resin oil pan is equal to or lower than that for the metal oil pan in substantially all the frequency bands, and thus the foamed resin oil pan, though lighter in weight than the metal oil pan, can reduce the noises. Especially, the sound pressure level is reduced in the frequency band of 5 to 8 kHz, in which a vibration-caused continual sound, if any, is very offensive to the ears, thereby suppressing the discomfort of the persons hearing the noises.

Figure 13:
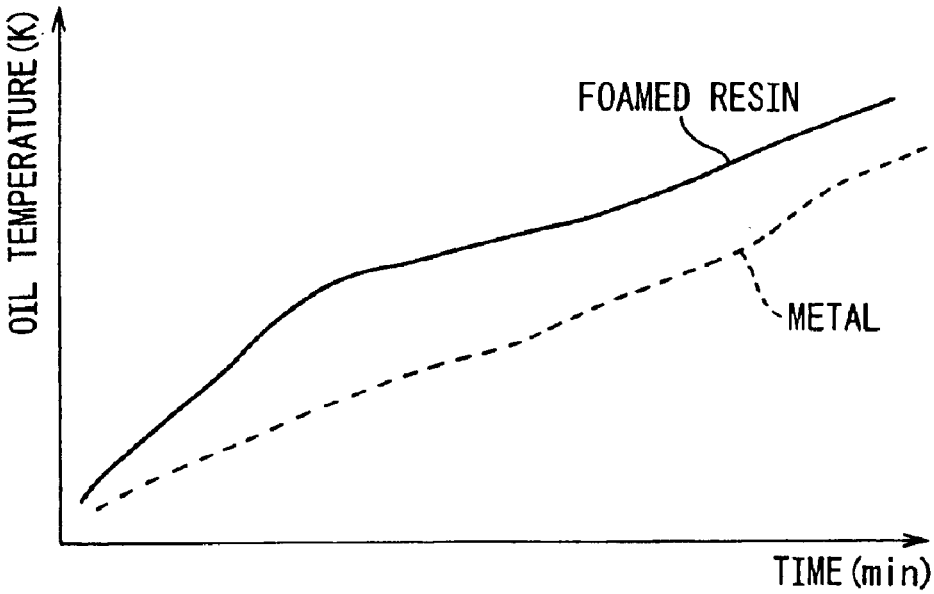
FIG. 13 is a diagram showing the heat insulating effect of the oil pan.

Also, by forming the oil pan, of foamed resin, the lubricant stored in the oil pan is rapidly increased in temperature by the heat insulating effect of the foamed resin in the manner as shown in FIG. 13 when the internal combustion engine is started from the cold state. FIG. 13 shows the temperature of the lubricant stored in the oil pan after the internal combustion engine is started from the cold state. The abscissa represents the time elapsed after the cold start of the internal combustion engine, and the ordinate the temperature of the lubricant stored in the oil pan. In FIG. 13, the solid line indicates the relation between time and oil temperature, for the foamed resin oil pan, and the dashed line the relation between time and oil temperature for the metal oil pan. As shown in FIG. 13, the temperature of the lubricant for each elapsed time length is higher for the foamed resin oil pan than for the metal oil pan. Thus, the temperature of the lubricant is increased after cold engine start more rapidly for the foamed resin oil pan than for the metal oil pan.

While the invention has been described by reference to specific embodiments chosen for purposes of illustration, it should be apparent that numerous modifications could be made thereto by those skilled in the art without departing from the basic concept and scope of the invention.

What is claimed is:

1. A foamed resin oil pan comprising:

a body portion; and a flange portion for mounting said body portion on a cylinder block;

wherein the bubble fraction of the resin making up said body portion is higher than the bubble fraction of the resin making up said flange portion.

2. A foamed resin oil pan according to claim 1, wherein a reinforcing member higher in strength than the resin is arranged on selected one of the outer surface and the inner surface of at least that part on the road surface side of the body portion which is nearer to the road surface when said foamed resin oil pan is mounted on an internal combustion engine.

3. A foamed resin oil pan according to claim 1, wherein a sheet of a radiation heat insulating material is arranged on at least a part of the inner surface of said body portion.

4. A foamed resin oil pan according to claim 1, wherein a metal sheet is welded on at least the surface part of said flange portion in contact with said cylinder block.

5. A foamed resin oil pan according to claim 1, wherein said flange portion has a recess or recesses in a selected one of a surface and the opposite surface of said flange portion which is in contact with the cylinder block.

6. A foamed resin oil pan according to claim 5, wherein said recess is a groove formed along said flange portion in the surface thereof in contact with the cylinder block, and a seal member is arranged in said groove.

7. A method of fabricating the foamed resin oil pan set forth in claim 1, comprising the steps of:

forming a cavity to form said oil pan between a first die and a second die by closing said two dies with each other;

filling molten resin in said cavity; and moving a movable core constituting a part of said first die facing said body portion so as to enlarge said cavity.

* * * * *